US011373591B2

(12) United States Patent
Li et al.

(10) Patent No.: US 11,373,591 B2
(45) Date of Patent: Jun. 28, 2022

(54) DISPLAY CONTROL METHOD, DISPLAY CONTROL DEVICE, AND COMPUTER-READABLE STORAGE MEDIUM

(71) Applicant: Beijing Xiaomi Mobile Software Co., Ltd., Beijing (CN)

(72) Inventors: Jiajin Li, Beijing (CN); Lintao Zhang, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 17/126,622

(22) Filed: Dec. 18, 2020

(65) Prior Publication Data

US 2021/0407398 A1 Dec. 30, 2021

(30) Foreign Application Priority Data

Jun. 30, 2020 (CN) ..... 202010624042.8

(51) Int. Cl.

*G09G 3/3225* (2016.01)
*G09G 3/3266* (2016.01)
*G09G 3/3275* (2016.01)

(52) U.S. Cl.

CPC ..... *G09G 3/3225* (2013.01); *G09G 3/3266* (2013.01); *G09G 3/3275* (2013.01); *G09G 2320/0257* (2013.01)

(58) Field of Classification Search

CPC ... G09G 3/32–3291; G09G 2320/0257; G09G 2320/043–048

See application file for complete search history.

(56) References Cited

U.S. PATENT DOCUMENTS

2012/0256971 A1 10/2012 Shin et al.
2018/0182285 A1 6/2018 Wang
2020/0211454 A1* 7/2020 Ohnishi ..... G09G 3/30
2021/0134246 A1* 5/2021 Li ..... G09G 3/3225

FOREIGN PATENT DOCUMENTS

WO WO 2018225338 A1 12/2018

OTHER PUBLICATIONS

Extended European Search Report in European Application No. 20215652.7, dated May 31, 2021.

* cited by examiner

*Primary Examiner* — Hang Lin
(74) *Attorney, Agent, or Firm* — Finnegan, Henderson, Farabow, Garrett & Dunner, L.L.P.

(57) ABSTRACT

A display control method includes: determining a drive charge amount for driving display of a current pixel, and a threshold for charge amount determination for the pixel circuit, wherein the threshold for charge amount determination is configured to trigger start of determining an accumulated charge amount in the pixel circuit; and in response to the drive charge amount being less than the threshold for charge amount determination, adjusting the drive charge amount for driving the display of the current pixel.

18 Claims, 11 Drawing Sheets

DISPLAY CONTROL METHOD, DISPLAY CONTROL DEVICE, AND COMPUTER-READABLE STORAGE MEDIUM

CROSS-REFERENCE TO RELATED APPLICATION

This application is based upon and claims priority to Chinese Patent Application No. 202010624042.8, filed on Jun. 30, 2020, the entire content of which is incorporated herein by reference.

TECHNICAL FIELD

The disclosure relates to the field of display screen technologies, and more particularly, to a display control method, a display control device, and a computer-readable storage medium.

BACKGROUND

An organic light-emitting diode (OLED) is also known as an organic electroluminescent diode or an organic light-emitting semiconductor. OLED is a current-mode organic light-emitting device, which causes an occurrence of light-emitting phenomenon through injection and recombination of current carriers. A light-emitting intensity is proportional to a magnitude of an injected current. OLED display technologies may include a passive mode (passive matrix, i.e., PM-OLED) and an active mode (active matrix, i.e., AMOLED) based on driving modes. Active matrix (AM) refers to a technology behind addressing of pixels. AMOLED is a mainstream device widely used in existing display devices. The AMOLED may include an electro-luminescence (EL) layer, a control circuit, and other layers. Components of the control circuit may have process defects. When a display screen is operating, charges are accumulated in the control circuit due to the process defects. When the charges are not discharged immediately and a value of accumulated charges is too large, temporary afterimages on display frames are caused easily, thereby affecting user experience.

SUMMARY

According to a first aspect of embodiments of the disclosure, a display control method is applicable for an organic light-emitting diode (OLED) display screen including a pixel circuit. The display control method includes: determining a drive charge amount for driving a display of a current pixel, and a threshold for charge amount determination for the pixel circuit, wherein the threshold for charge amount determination is configured to trigger a start of determining an accumulated charge amount in the pixel circuit; and in response to the drive charge amount being less than the threshold for charge amount determination, adjusting the drive charge amount for driving the display of the current pixel.

According to a second aspect of embodiments of the disclosure, a display control device is applicable for an organic light-emitting diode (OLED) display screen including a pixel circuit. The display control device includes: a processor; and a memory for storing instructions executable by the processor. The processor is configured to perform: determining a drive charge amount for driving a display of a current pixel, and a threshold for charge amount determination for the pixel circuit, wherein the threshold for charge amount determination is configured to trigger a start of determining an accumulated charge amount in the pixel circuit; and in response to the drive charge amount being less than the threshold for charge amount determination, adjusting the drive charge amount for driving the display of the current pixel.

According to a third aspect of embodiments of the disclosure, a computer-readable storage medium has stored therein instructions that, when executed by a processor of a device, cause the device to perform the display control method according to the first aspect.

It is understood that the above general description and the following detailed description are only exemplary and explanatory, and cannot limit the disclosure.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

DETAILED DESCRIPTION

Figure 1:
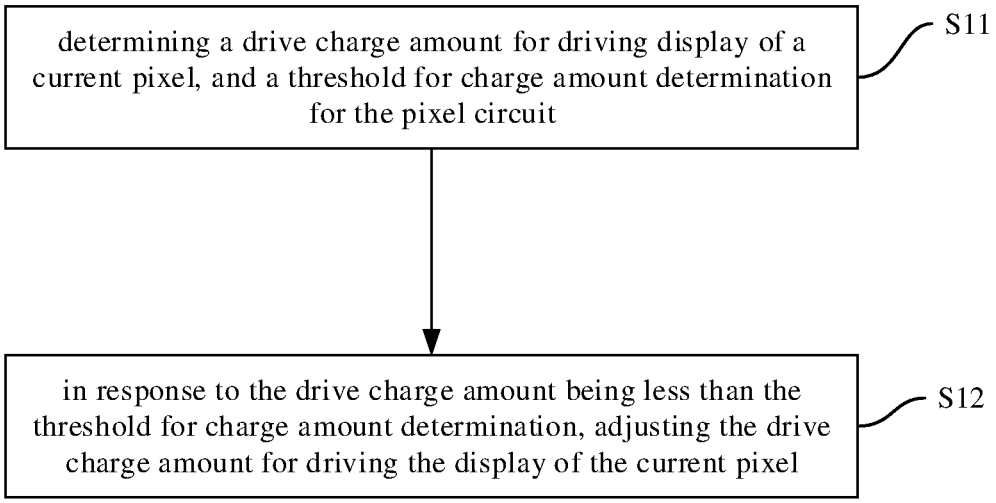
FIG. 1 is a flowchart of a display control method according to exemplary embodiments.

Reference will now be made in detail to exemplary embodiments, examples of which are illustrated in accompanying drawings. The following description refers to the accompanying drawings in which the same numbers in different drawings represent the same or similar elements unless otherwise represented. The implementations set forth in the following description of exemplary embodiments do not represent all implementations consistent with the disclosure. Instead, they are merely examples of apparatuses and methods consistent with aspects related to the disclosure as recited in the appended claims.

In the related art, a base of AMOLED is an organic light-emitting body. Thousands of transistors of controlling light-emitting units (each light-emitting unit may emit a single-pixel light source under the control of the corresponding transistor), may be placed on a substrate of a screen in a specific form. When a voltage is applied to the transistor, the corresponding light-emitting unit may emit light corresponding to the pixel. The transistors of controlling the light-emitting units may include pixel data thin film transistors (DTFT). The single-pixel light source may include any one of red, green and blue pixel light sources. When an AMOLED display panel is configured to display pixels, the drive charge amount that drives the DTFT to display the pixels is adjusted to display pixels of different brightness. In applications, AMOLED display panel technologies adopt scanning signals (row drive signals) and data signals (column drive signals) to control the pixel circuit, so that a light-emitting layer between a cathode and an anode of the pixel circuit is triggered by current carriers to emit light. The pixel circuit is located in the DTFT. When the display screen emits light, the pixel circuit, based on a pixel to be displayed, generates charges for driving the display of the pixel. In the process of displaying the pixel, the generated charges may be consumed. However, due to a long-term usage of the display screen, metal oxide semiconductor (MOS) tubes in the pixel circuit, corresponding to the data signals, may cause electrical characteristics of gates as a working length of the circuit increases, resulting in transient shift. Therefore, sizes of the carriers driven by the voltages within a period of time through values of the constantly updated data signals also shift, and some carriers flow into capacitors in the pixel circuit to form accumulated charge amounts. Due to the accumulated charge amount, when the pixel is driven and displayed again, the drive charge amount of the pixel circuit is greater than a required charge amount, which causes the display brightness of the pixel to be too bright, thus temporary afterimages is caused, that is, hysteresis effect, and visual effect experience of the user is affected.

Embodiments of the present disclosure provide a display control method. Based on a drive charge amount required for driving the display of a current pixel, and a threshold for charge amount determination for a pixel circuit and for triggering the start of determining the accumulated charge amount in the pixel circuit, a drive charge amount for driving the display of the current pixel is adjusted. The current pixel is driven and displayed based on the adjusted charge amount to improve visual impact of temporary afterimages caused by hysteresis effects on the user, thereby enhancing the user's visual experience.

FIG. 1 is a flowchart of a display control method according to exemplary embodiments. For example, the display control method is applied in an organic light-emitting diode (OLED) display screen, the OLED display screen including a pixel circuit. Referring to FIG. 1, the display control method includes the following actions.

At block S11, a drive charge amount for driving display of a current pixel, and a threshold for charge amount determination for the pixel circuit, are determined.

In embodiments of the disclosure, in the OLED display screen, the display brightness of the pixel depends on the drive charge amount in the DTFT. The value of the drive charge amount in the pixel circuit corresponds to the voltage applied to the gate of the MOS tube. The larger the applied voltage, the larger the drive charge amount, the larger the current generated, and the larger the light intensity emitted by the light-emitting unit. Different drive charge amounts are required for different light intensities. That is, the drive charge amount required for driving and displaying the current pixel to be displayed is determined based on the brightness intensity of the current pixel.

Figure 2:
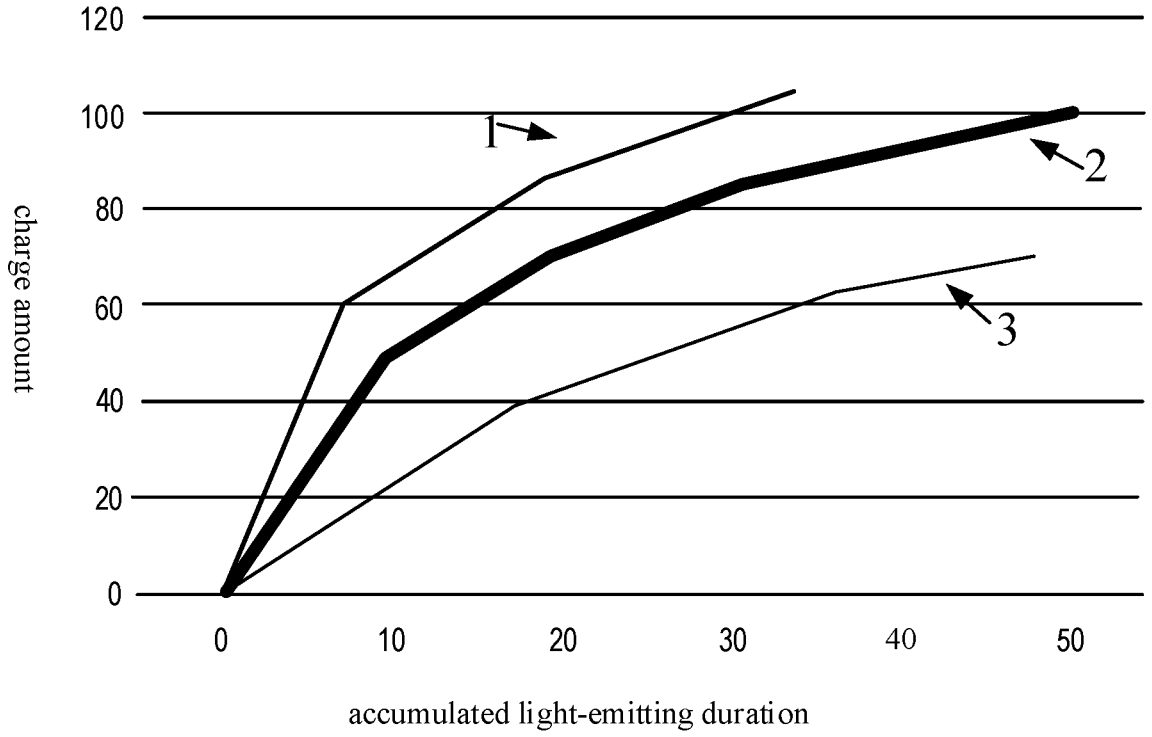
FIG. 2 is a diagram of a linear relationship among drive charge amounts, accumulated light-emitting durations, and accumulated charge amounts according to exemplary embodiments.

In the DTFT, the accumulated charge amount of the pixel circuit may be related to the usage duration (the accumulated light-emitting duration) of the transistor of controlling the light-emitting unit. In the pixel circuit, for a certain drive charge amount, the accumulated charge amount has a linear relationship with the accumulated light-emitting duration. As the accumulated light-emitting duration increases, the accumulated charge amount in the pixel circuit also increases. If different drive charge amounts are used to drive the display of the same pixel, the linear relationships between the accumulated charge amounts in the pixel circuit and the accumulated light-emitting durations are different. In the same duration, the greater the drive charge amount, the greater the corresponding accumulated charge amount. For example, as illustrated in FIG. 2, curve 1, curve 2, and curve 3 respectively represent different drive charge amounts, and for the same accumulated light-emitting duration, the drive charge amount in curve 1>the drive charge amount in curve 2>the drive charge amount in curve 3. With the same duration, the accumulated charge amount for curve 1 is the largest, followed by for curve 2, and finally for curve 3. However, due to self-use characteristics of the DTFT, when the accumulated light-emitting duration of the DTFT exceeds a certain period of time, the speed of releasing the charge amount for driving the display of the pixel may be lower than the speed of acquiring the charge amount for driving the display of the pixel, thus the accumulated charge amount in the pixel circuit may be unable to release the accumulated charges in a limited duration. Due to a long-term usage of the pixel circuit, part of the charges generated when the gates of the MOS tubes are triggered in the pixel circuit gradually accumulates in the capacitors of the pixel circuit, thus a phenomenon of capacitor charging is formed. If the light intensity of the pixel is reduced or suspended at this time, the drive charge amount acquired in the pixel circuit is reduced rapidly. In addition to the drive charge amount for driving the display of the current pixel, the DTFT also includes the accumulated charge amount in the pixel circuit that is not discharged in time, a brightness of the pixel at this time is greater than a brightness of the pixel to be displayed, thus hysteresis effect occurs, and phenomenon of temporary afterimages is caused.

The accumulated charge amount in the pixel circuit is increasing. When the voltage is small (e.g., when the drive charge amount is small, or the light intensity is low), the accumulated charge amount in the pixel circuit is relatively low, the impact on the hysteresis effect is small, and it may be unnecessary to determine the accumulated charge amount. However, when the voltage is large (e.g., when the drive charge amount is large, or the light intensity is large), and the light intensity of the pixel decreases after the pixel is driven by a large voltage for a certain period of time, the possibility of the hysteresis effect on the display screen is relatively large, and it may be necessary to determine the accumulated charge amount to avoid the hysteresis effect. In embodiments of the disclosure, according to the characteristics of the panel, after driving the pixel with a certain drive charge amount to display with a certain light intensity for a specified duration, when the screen gets dark, and there is a hysteresis effect, the value of the accumulated charge amount in the pixel circuit is determined (e.g., by conducting statistics), which is referred to as the threshold for charge amount determination.

In embodiments of the disclosure, in order to facilitate the DTFT to perform better display and reduce the occurrence of the hysteresis effect caused by long-term usage, the usage characteristics of the DTFT is used to determine the threshold for charge amount determination in the pixel circuit. The threshold for charge amount determination is understood as a threshold for triggering the pixel circuit to start determining the accumulated charge amount of the pixel circuit. Further, it is understood that when the drive charge amount of a certain pixel exceeds the threshold for charge amount determination, the statistic is performed on the accumulated charge amount of the pixel circuit. The thresholds for charge amount determination, corresponding to different panels produced by different manufacturers, may be different.

Figure 3:
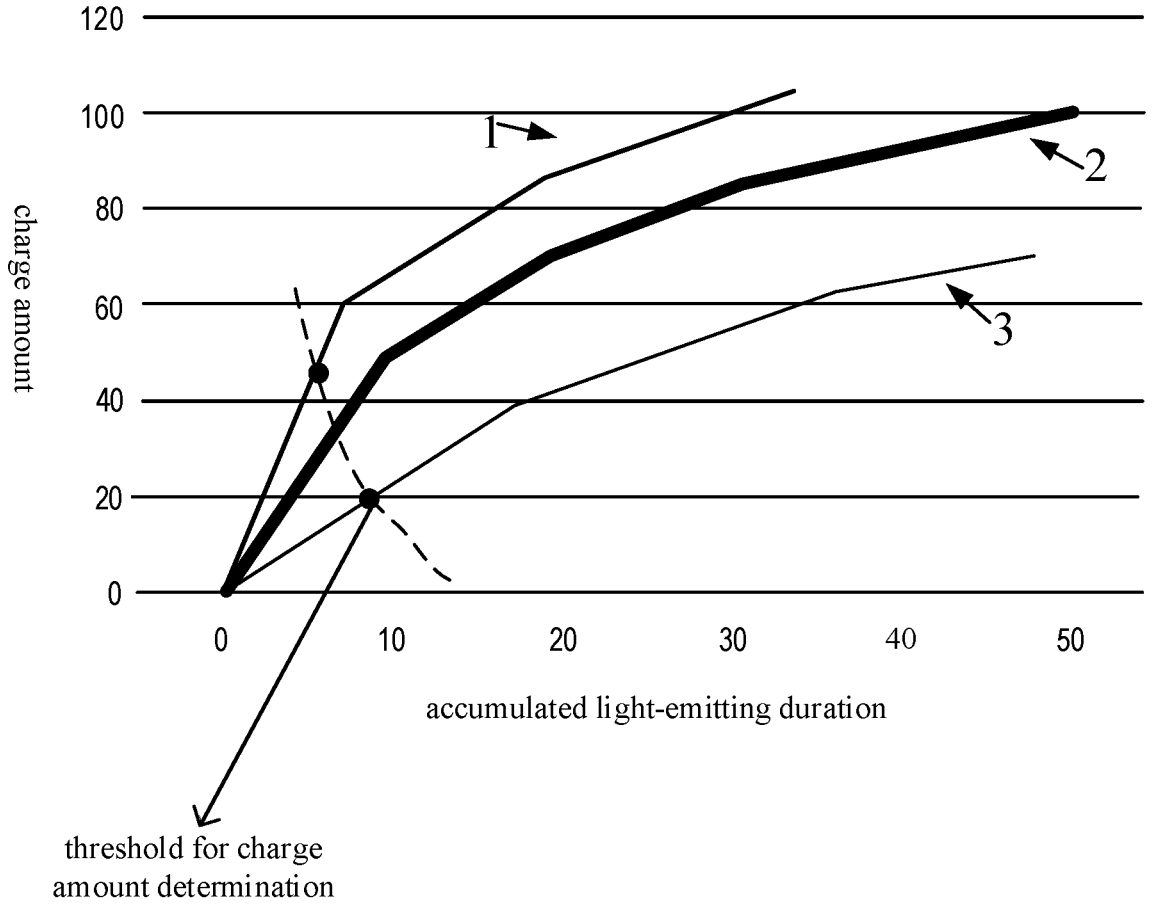
FIG. 3 is a diagram of a correspondence among drive charge amounts, accumulated light-emitting durations, thresholds for charge amount determination, and accumulated charge amounts, according to exemplary embodiments.

Further, the thresholds for charge amount determination, corresponding to different drive charge amounts, may also be different. Generally, the greater the drive charge amount, the shorter the duration for triggering the start of determining the accumulated charge amount, and the smaller the drive charge amount, the longer the duration for triggering the start of determining the accumulated charge amount. FIG. 3 illustrates the correspondence among drive charge amounts, accumulated light-emitting durations, thresholds for charge amount determination, and accumulated charge amounts according to exemplary embodiments of the disclosure. As illustrated in FIG. 3, curve 1, curve 2, and curve 3 respectively represent different drive charge amounts, and the thresholds for charge amount determination, corresponding to curve 1, curve 2, and curve 3, are sequentially reduced.

Referring back to FIG. 1, at block S12, in response to the drive charge amount required being less than the threshold for charge amount determination, the drive charge amount for driving the display of the current pixel is adjusted.

In embodiments of the disclosure, the accumulated charge amount of the pixel circuit is continuously increased or discharged with the light-emitting duration of the OLED. In order to ensure the display effect of the current pixel, before driving the display of the current pixel, the charge amount required for driving the display of the current pixel is compared with the threshold for charge amount determination in advance to determine whether the drive charge amount required triggers the determining of the accumulated charge amount in the pixel circuit. If the drive charge amount required for driving the display of the current pixel is greater than the threshold for charge amount determination, the pixel circuit performs display with larger light intensity when the drive charge amount, required for the current pixel, is employed, and the accumulated charge amount in the pixel circuit does not affect the driving of the display of the current pixel, nor does it produce the hysteresis effect. Therefore, when the drive charge amount is greater than the threshold for charge amount determination, the drive charge amount may not be adjusted, the drive charge amount may maintain unchanged for driving the display of the current pixel, and the accumulated charge amount in the pixel circuit is included in the determination. If the drive charge amount required for driving the display of the current pixel is less than the threshold for charge amount determination, the pixel circuit performs display with lower light intensity when the drive charge amount, required by the current pixel, is employed, and the accumulated charge amount in the pixel circuit cause the hysteresis effect, and then affect the normal display of the current pixel. Therefore, when the drive charge amount is less than the threshold for charge amount determination, the accumulated charge amount in the pixel circuit is not determined, and part of the accumulated charge amount in the pixel circuit is discharged, and the charge amount for driving the display of the current pixel is adjusted based on the charge amount after part of the accumulated charge amount is discharged to ensure that the current pixel is displayed normally.

In embodiments of the disclosure, the accumulated charge amount in the pixel circuit is determined by an image data processing chip with recording function or a display driving chip with recording function. The image data processing chip with recording function or the display driving chip with recording function may determine the accumulated charge amount. There is a correspondence among drive charge amounts, accumulated light-emitting durations, and accumulated charge amounts. According to the accumulated light-emitting duration and the drive charge amount, the corresponding accumulated charge amount and the threshold for charge amount determination may be found. When the drive charge amount exceeds the threshold for charge amount determination, the accumulated charge amount is determined. When the drive charge amount does not exceed the threshold for charge amount determination, the accumulated charge amount is not determined.

Embodiments of the disclosure also provide a display control method through which it is determined whether using the current charge amount required for driving the display may produce a hysteresis effect, and then it is determined whether it is necessary to adjust the charge amount for driving the display and whether the charge amount required is included in the accumulated light-emitting charge amount during determination.

Figure 4:
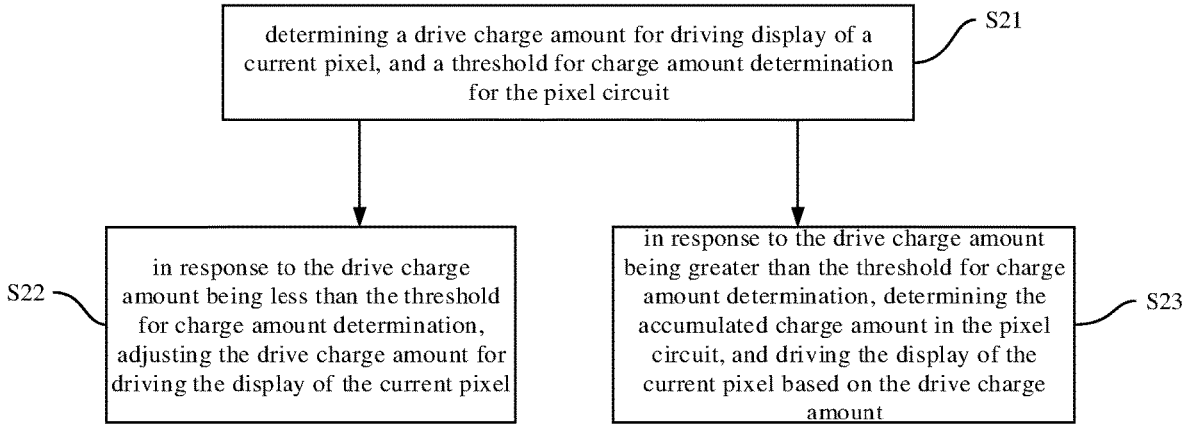
FIG. 4 is a flowchart of a display control method according to exemplary embodiments.

FIG. 4 is a flowchart of a display control method according to exemplary embodiments. As illustrated in FIG. 4, the display control method includes the following actions.

At block S21, a drive charge amount for driving display of a current pixel, and a threshold for charge amount determination for the pixel circuit, are determined.

At block S22, when the drive charge amount is less than the threshold for charge amount determination, the drive charge amount for driving the display of the current pixel is adjusted.

At block S23, when the drive charge amount is greater than the threshold for charge amount determination, the accumulated charge amount in the pixel circuit is determined, e.g., by conducting statistics on the accumulated charge amount, and the display of the current pixel is driven based on the drive charge amount.

In embodiments of the disclosure, based on the comparison between the drive charge amount and the threshold for charge amount determination, when it is determined that the drive charge amount is greater than the threshold for charge amount determination, the accumulated charge amount of the pixel circuit is determined, and the required drive charge amount is directly used for driving the display of the current pixel.

Embodiments of the disclosure also provide a display control method, in which if the drive charge amount required for driving the display of the current pixel is less than the threshold for charge amount determination, the charge amount required for driving the display of the current pixel is adjusted based on the current accumulated charge amount in the pixel circuit, so as to avoid or alleviate the hysteresis effect.

Figure 5:
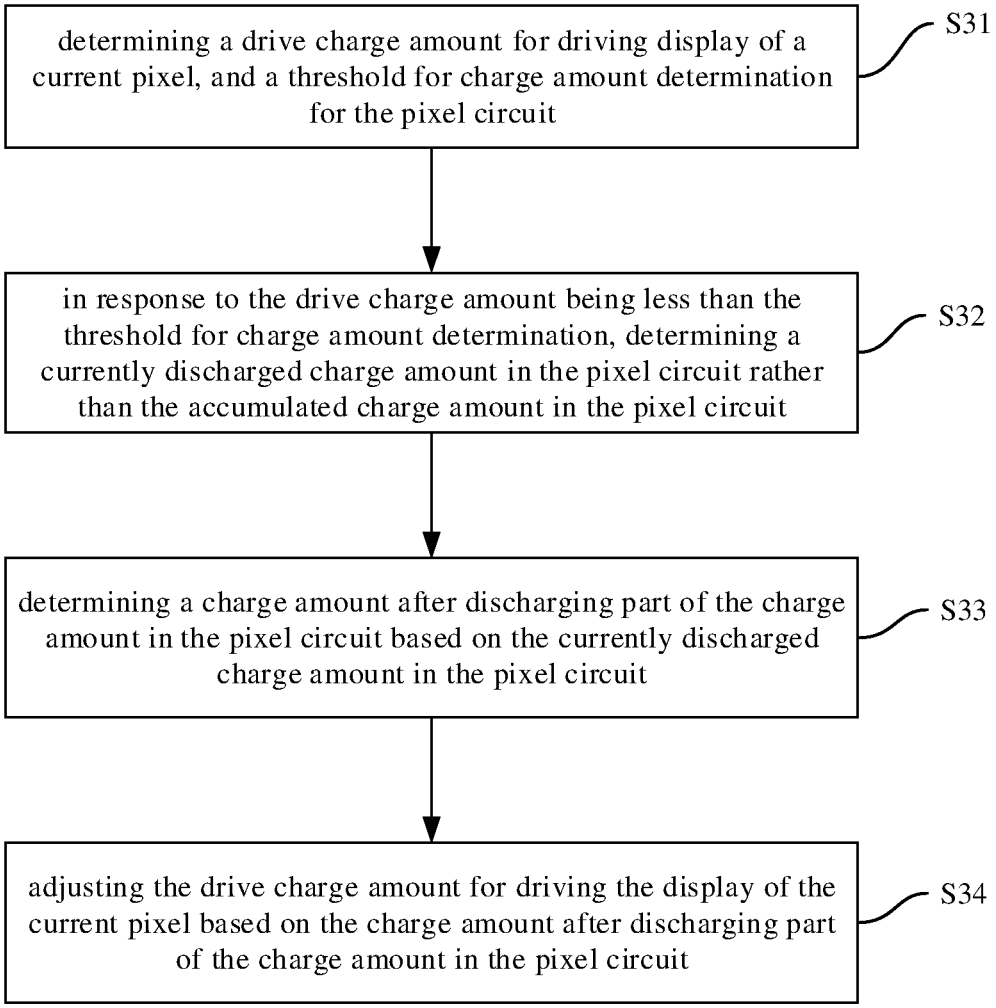
FIG. 5 is a flowchart of a display control method according to exemplary embodiments.

FIG. 5 is a flowchart of a display control method according to exemplary embodiments. As illustrated in FIG. 5, the display control method includes the following actions.

At block S31, a drive charge amount for driving display of a current pixel, and a threshold for charge amount determination for the pixel circuit, are determined.

At block S32, in response to the drive charge amount being less than the threshold for charge amount determination, a currently discharged charge amount in the pixel circuit, rather than the accumulated charge amount in the pixel circuit, is determined, e.g., by conducting statistics on the discharged charge amount.

In embodiments of the disclosure, based on the comparison between the drive charge amount and the threshold for charge amount determination, when it is determined that the drive charge amount is less than the threshold for charge amount determination, the display brightness of the current pixel is dark, and the accumulated charge amount of the pixel circuit is discharged currently. In order to determine a remaining charge amount after part of the accumulated charge amount of the pixel circuit is discharged, it may be necessary to determine the charge amount currently discharged in the pixel circuit, to facilitate determining whether the charge amount for driving the display needs to be adjusted.

Figure 6:
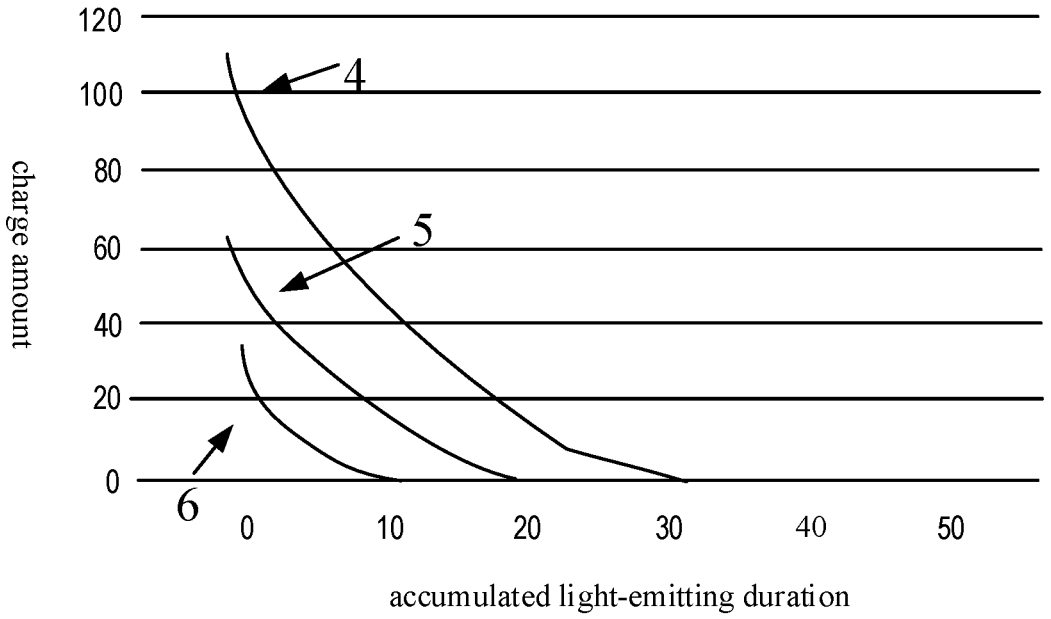
FIG. 6 is a diagram of a correspondence among drive charge amounts, accumulated light-emitting durations, and discharged charge amounts according to exemplary embodiments.

In the pixel circuit, the discharged charge amount may have a linear relationship with the accumulated light-emitting duration. As the working duration of the pixel circuit increases, the discharged charge amount also decreases. If different drive charge amounts are used to drive the display of the same pixel, the linear relationships between the discharged charge amounts in the pixel circuit and the accumulated light-emitting durations are also different. In the same duration, the greater the drive charge amount, the greater the discharged charge amount. For example, FIG. 6 is a schematic diagram of a correspondence among drive charge amounts, accumulated light-emitting durations, and discharged charge amounts according to exemplary embodiments. As illustrated in FIG. 6, curve 4, curve 5, and curve 6 respectively represent different drive charge amounts, and for the same accumulated light-emitting duration, the drive charge amount in curve 4>the drive charge amount in curve 5>the drive charge amount in curve 6. In the same duration, the discharged charge amount of the drive charge amount in curve 4 is the largest, followed by curve 5, and finally curve 6. Through this linear relationship, it is possible to determine the charge amount discharged by the accumulated charge amount at each moment in the pixel circuit. Furthermore, when determining the charge amount currently discharged in the pixel circuit, determination is made based on the correspondence between discharged charge amounts and accumulated light-emitting durations.

Referring back to FIG. 5, at block S33, a charge amount after discharging part of the charge amount in the pixel circuit is determined based on the currently discharged charge amount in the pixel circuit.

In embodiments of the disclosure, the image data processing chip with recording function or the display driving chip with recording function records the correspondence among the drive charge amounts, the accumulated light-emitting durations, and the accumulated charge amounts, as well as the correspondence among the drive charge amounts, the accumulated light-emitting durations, and the discharged charge amounts. Therefore, based on the correspondence among the drive charge amounts, the accumulated light-emitting durations, and the accumulated charge amounts, the current accumulated charge amount corresponding to the drive charge amount of the current pixel is determined. Based on the correspondence among the drive charge amounts, the accumulated light-emitting durations, and the discharged charge amounts, the currently discharged charge amount corresponding to the drive charge amount of the current pixel is determined. A difference between the current accumulated charge amount and the currently discharged charge amount is used as the charge amount after part of the charge amount is discharged in the pixel circuit.

At block S34, the drive charge amount for driving the display of the current pixel is adjusted based on the charge amount after discharging part of the charge amount in the pixel circuit.

In embodiments of the disclosure, the charge amount after discharging part of the charge amount in the pixel circuit affects the brightness of the driven display of the current pixel. After discharging part of the charge amount, the afterimages produced in pixels displayed with different brightness intensities are different to the human eyes. If the charge amount after discharging part of the charge amount in the pixel circuit is small or close to zero, when the display is driven based on the required drive charge, afterimages may not be easily produced or the resulting afterimages may not be easily perceivable by the human eyes. The continuous release of the charges in the pixel circuit quickly eliminate the afterimages, which is adjusted based on charge release characteristics of the pixel circuit itself. There is no need to adjust the charge amount for driving the display of the current pixel, which is conductive to saving computing costs. If the charge amount after discharging part of the charge amount in the pixel circuit is large, it means that only the release of the charge amount of the pixel circuit itself may not quickly meet the requirements of the current pixel for normal display. Therefore, the charge amount that drives the display of the current pixel needs to be adjusted. The purpose of reducing or eliminating temporary afterimages has been achieved. Adjusting the drive charge amount for driving the display of the current pixel includes: adjusting the remaining charge amount of the pixel circuit or the required drive charge amount, or adjusting the remaining charge amount of the pixel circuit and the required drive charge amount.

Figure 7:
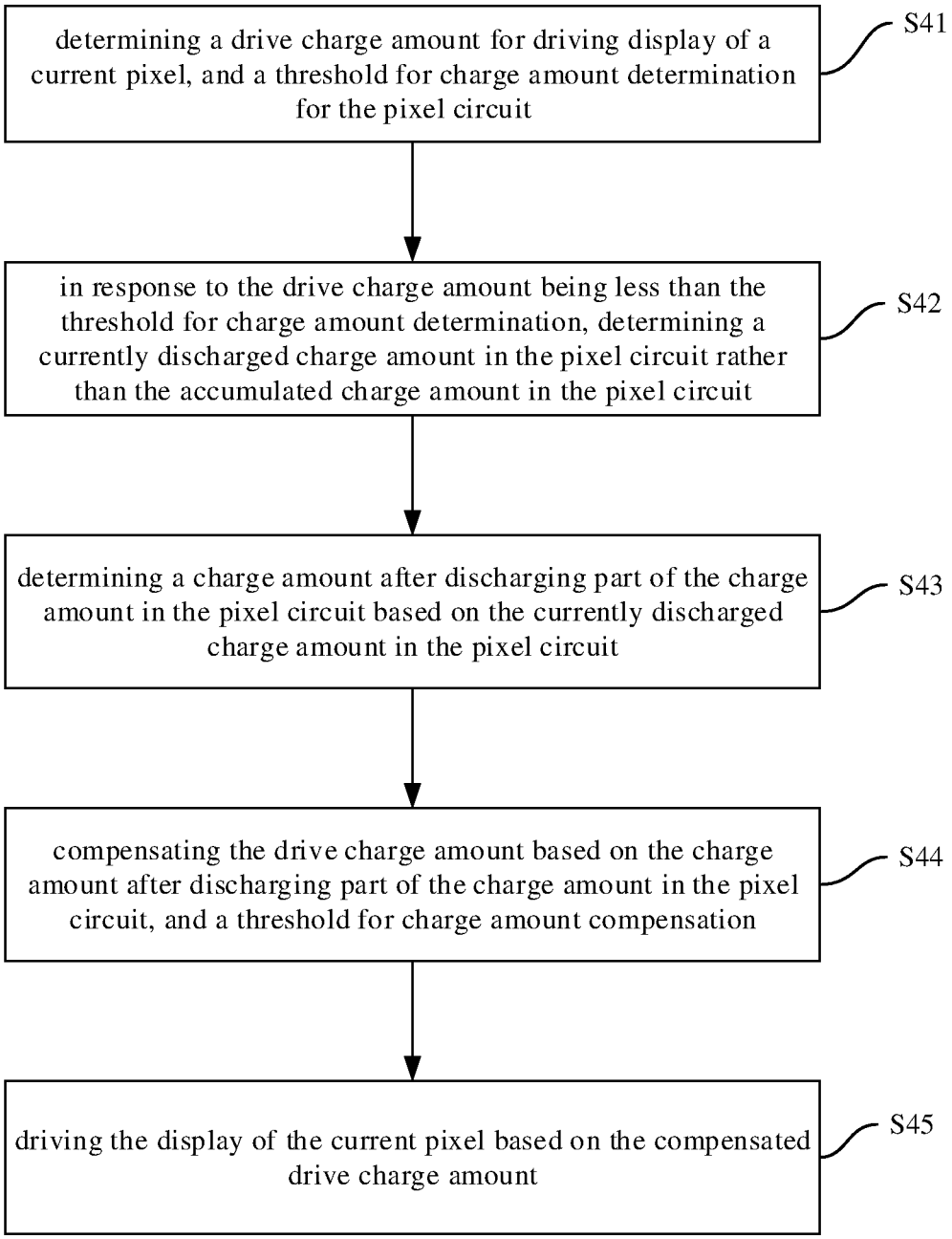
FIG. 7 is a flowchart of a display control method according to exemplary embodiments.

FIG. 7 is a flowchart of a display control method according to exemplary embodiments. As illustrated in FIG. 7, the display control method includes the following actions.

At block S41, a drive charge amount for driving display of a current pixel, and a threshold for charge amount determination for the pixel circuit, are determined.

At block S42, in response to the drive charge amount being less than the threshold for charge amount determination, a currently discharged charge amount in the pixel circuit, rather than the accumulated charge amount in the pixel circuit, is determined.

At block S43, a charge amount after discharging part of the charge amount in the pixel circuit is determined based on the currently discharged charge amount in the pixel circuit.

At block S44, the drive charge amount is compensated based on the charge amount after discharging part of the charge amount in the pixel circuit and a threshold for charge amount compensation.

In embodiments of the disclosure, the threshold for charge amount compensation may be the accumulated charge amount that triggers the human eyes to perceive the afterimages of the pixel circuit. The charge amount after releasing part of the charge amount in the pixel circuit causes the hysteresis effect. However, the charge amounts after releasing part of the charge amount are different, and the afterimages produced in the pixels displayed with different brightness intensities are different to the human eyes. In embodiments of the disclosure, different thresholds for charge amount compensation are set for the same pixel under different light intensities. The embodiments of the disclosure may obtain different thresholds for charge amount compensation for different light intensities (drive charge amounts) based on experiments. When correcting the drive charge amount, the corresponding threshold for charge amount compensation is determined based on the currently required light intensity. Based on the charge amount after the charge is discharged in the pixel circuit and the threshold for charge amount compensation, the drive charge amount is compensated to avoid the hysteresis effect, in which, the afterimages are perceived by the human eyes.

In embodiments, when the charge amount after part of the charge amount is discharged in the pixel circuit is greater than the threshold for charge amount compensation, it means that the current pixel is driven to display based on the remaining charge amount in the current pixel circuit by combining with the required drive charge amount, and the light intensity corresponding to the display is easily perceivable by the human eyes, which affects the user's use experience, thus it is necessary to compensate the drive charge amount and adjust the drive charge amount for driving the display of the current pixel. Based on different drive charge amounts, the corresponding thresholds for charge amount compensation are different.

At block S45, the display of the current pixel is driven based on the compensated drive charge amount.

In embodiments of the disclosure, when the charge amount is compensated, the threshold for charge amount compensation corresponding to the drive charge amount and the remaining charge amount in the pixel circuit after part of the charge amount is discharged are used to compensate the drive charge amount, and then the display of the current pixel is driven based on the compensated drive charge amount. For example, if the threshold for charge amount determination is 60 coulombs, and the current drive charge amount is 50 coulombs, the currently discharged charge amount in the pixel circuit is determined. It is assumed that, based on the correspondence among the drive charge amounts, the accumulated light-emitting durations and the accumulated charge amounts, it is determined that the current accumulated charge amount for the drive charge amount in the current pixel circuit is 20 coulombs. Based on the correspondence among the drive charge amounts, the accumulated light-emitting durations and the discharged charge amounts, it is determined that the currently discharged charge amount corresponding to the drive charge amount in the current pixel circuit is 1 coulomb. At this moment, the remaining charge amount after discharging part of the charge amount in the pixel circuit is 20−1=19 coulombs. If the threshold for charge amount compensation for the current drive charge amount is 15 coulombs, the remaining charge amount is greater than the threshold for charge amount compensation. In order to reduce the impact of the light intensity on human visual sense, the drive charge amount is compensated, and the compensated charge amount is 50-(20-1)=31 coulombs. The drive charge amount in the pixel circuit is corrected from 50 coulombs to 31 coulombs, and 31 coulombs is contributed to drive the current pixel to eliminate the hysteresis effect.

Figure 8:
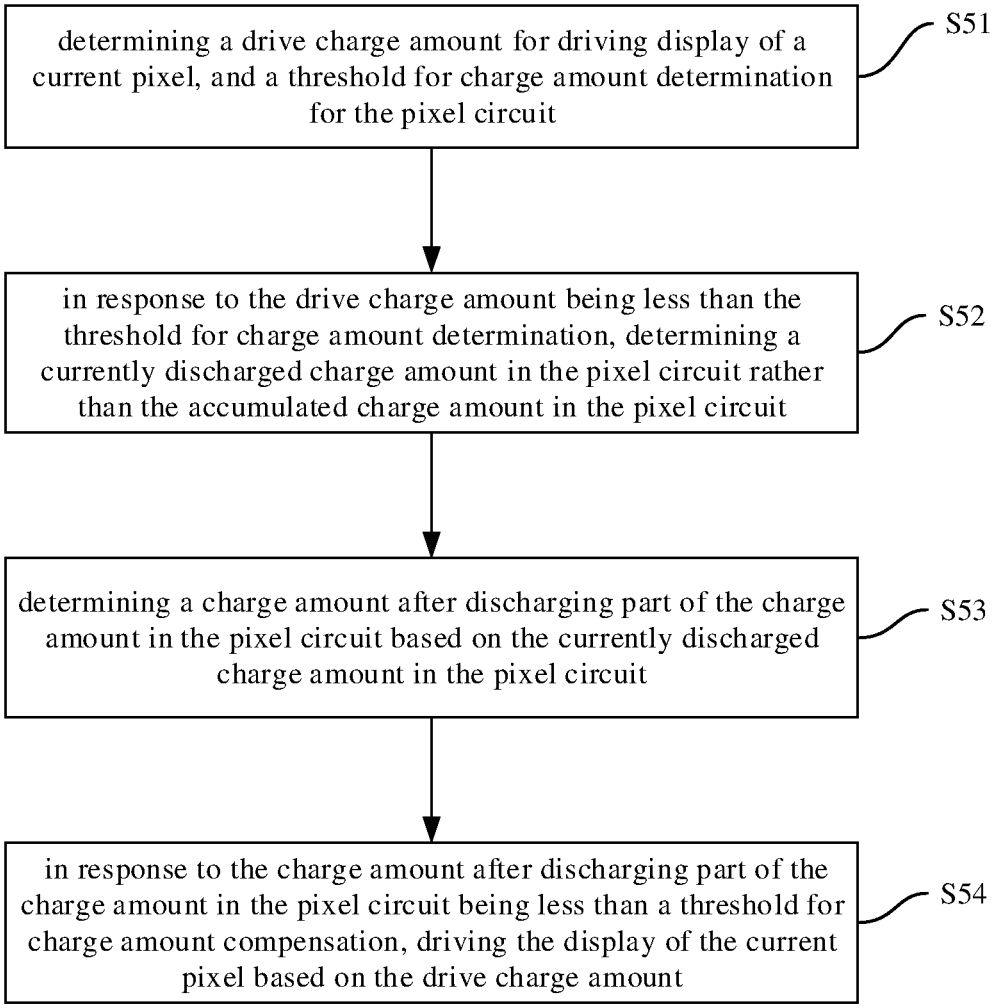
FIG. 8 is a flowchart of a display control method according to exemplary embodiments.

FIG. 8 is a flowchart of a display control method according to exemplary embodiments. As illustrated in FIG. 8, the display control method includes the following actions.

At block S51, a drive charge amount for driving display of a current pixel, and a threshold for charge amount determination for the pixel circuit, are determined.

At block S52, in response to the drive charge amount being less than the threshold for charge amount determination, a currently discharged charge amount in the pixel circuit, rather than the accumulated charge amount in the pixel circuit, is determined.

At block S53, a charge amount after discharging part of the charge amount in the pixel circuit is determined based on the currently discharged charge amount in the pixel circuit.

At block S54, in response to the charge amount after discharging part of the charge amount in the pixel circuit being less than a threshold for charge amount compensation, the display of the current pixel is driven based on the drive charge amount.

In embodiments of the disclosure, the charge amount after discharging part of the charge amount in the pixel circuit is less than the threshold for charge amount compensation, it indicates that the required drive charge amount is directly used to drive the display. However, the temporary afterimages formed are within acceptable ranges of human vision and does not seriously affect the user's visual experience. Therefore, the charge amount required to drive the display of the current pixel may not be adjusted.

Figure 9:
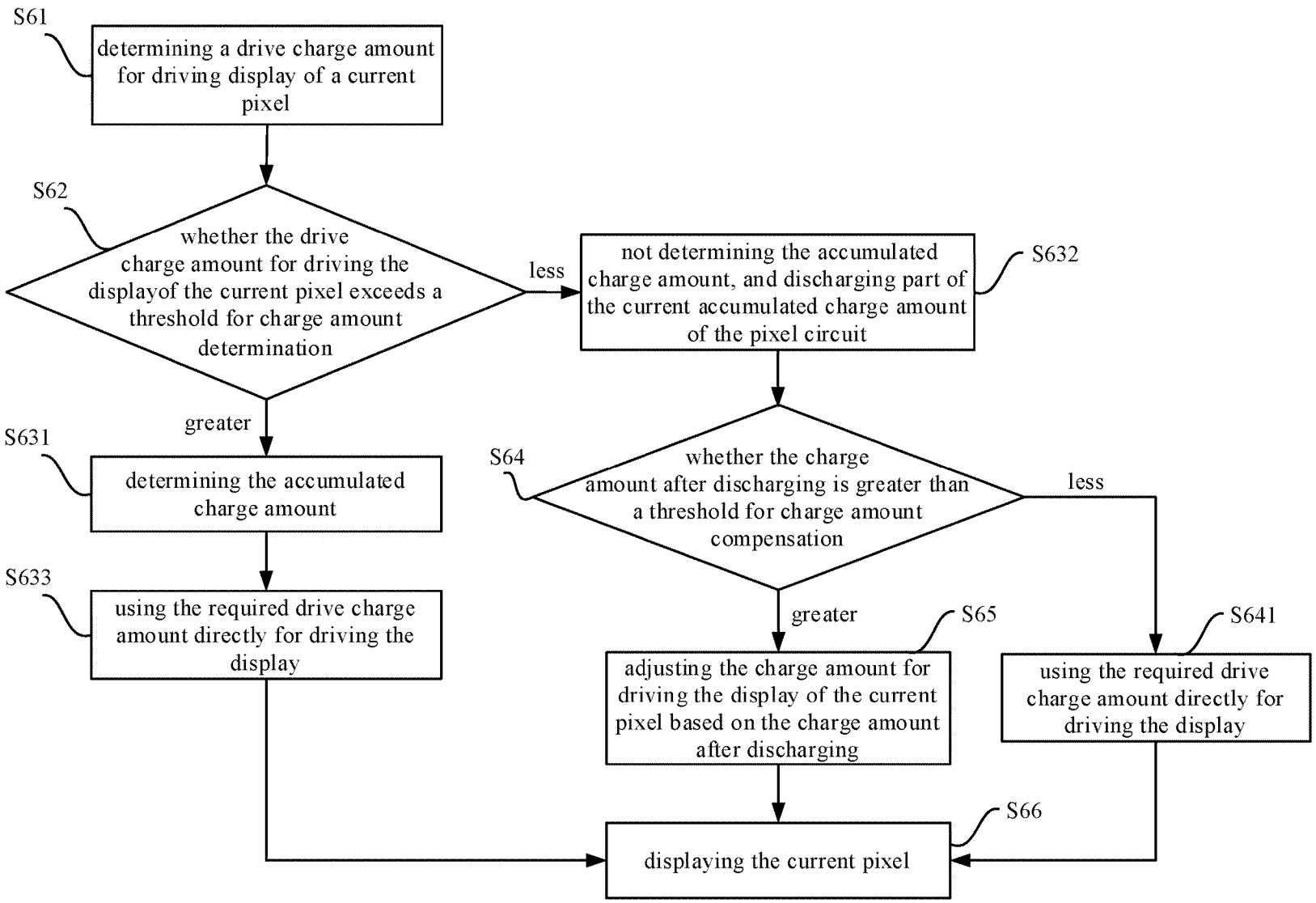
FIG. 9 is a flowchart of a display control method according to exemplary embodiments.

FIG. 9 is a flowchart of a display control method according to exemplary embodiments. As illustrated in FIG. 9, the display control method includes the following methods.

At block S61, a drive charge amount for driving display of a current pixel is determined.

In embodiments of the disclosure, the image data processing chip with recording function or the display driving chip with recording function is configured to determine the frame to be displayed currently. The scanning signals (row drive signals) and data signals (column drive signals) are used to control the pixel circuit, and all the pixels in the current frame are acquired one by one, and then the drive charge amount for driving the display of the current pixel through the AMOLED panel is determined.

At block S62, it is determined whether the drive charge amount for driving the display of the current pixel exceeds a threshold for charge amount determination.

In embodiments of the disclosure, the drive charge amount required for driving the display of the current pixel and the threshold for charge amount determination are determined to determine whether the pixel circuit will be triggered to determine the accumulated charge amount in the pixel circuit. If the drive charge amount exceeds the threshold of charge amount determination, an action at block S631 is executed to include the required drive charge amount into the determination, and the required drive charge amount is not adjusted, and the drive charge amount required by the current pixel is used to drive display at block S633. If the drive charge amount does not exceed the threshold of charge amount determination, an action at block S632 is executed to further determine whether it is necessary to compensate the drive charge amount of the current pixel for driving the display, so as to improve the visual impact.

At block S631, when the drive charge amount is greater than the threshold for charge amount determination, the accumulated charge amount is determined.

In embodiments of the disclosure, if the drive charge amount exceeds the threshold of charge amount determination, start of determining the accumulated charge amount of the pixel circuit is triggered, and the required drive charge amount is directly used to drive the display.

At block S632, when the drive charge amount is less than the threshold for charge amount determination, the accumulated charge amount is not determined, and part of the current accumulated charge amount of the pixel circuit is discharged.

In embodiments of the disclosure, if the drive charge amount required for driving the current pixel is less than the threshold for charge amount determination, the accumulated charge amount is not included in the determination, and the current accumulated charge amount in the pixel circuit is partially discharged.

At block S64, it is determined whether the charge amount after discharging is greater than a threshold for charge amount compensation.

In embodiments of the disclosure, by comparing the discharged charge amount with the threshold for charge amount compensation, it is determined whether the DTFT directly drives the display by adopting the required drive charge amount at this time, and whether the temporary afterimages produced will affect the user's visual effect, and then the charge amount of the current pixel is appropriately adjusted to drive the display, so as to improve or eliminate the phenomenon of temporary afterimages. If the remaining charge amount after discharging in the pixel circuit is greater than the threshold for charge amount compensation, the temporary afterimages affect the user's visual effect, and an action at block S65 is executed. If the remaining charge amount after discharging in the pixel circuit is less than the threshold for charge amount compensation, it means that although temporary afterimages are generated, the user's visual effect is not affected, and the required charge amount does not need to be adjusted. Thus, the drive charge amount required by the current pixel is used to drive display at block S641.

At block S65, the charge amount for driving the display of the current pixel is adjusted based on the charge amount after discharging.

In embodiments of the disclosure, when the charge amount after discharging in the pixel circuit is greater than the threshold for charge amount compensation, the temporary afterimages generated by driving the display based on the required drive charge amount is more obvious, which affects the user's visual effect. Therefore, while discharging part of the current accumulated charge amount in the pixel circuit, the drive charge amount required for driving the display of the current pixel is appropriately adjusted, so that the drive of the current pixel is performed based on the adjusted drive charge amount by combining with the discharged charge amount to achieve the originally required drive charge amount, and the temporary afterimages caused by the amount of unreleased charge accumulated in the pixel circuit are quickly reduced or eliminated within the effective time.

At block S66, the current pixel is displayed.

In an example, it is assumed that the drive charge amount at time T1 is 0, and the accumulated charge amount is 0. The drive charge amount at time T2 is 255 coulombs, the threshold for charge amount determination at time T2 is 100 coulombs, and the accumulated charge amount at time T2 is 10 coulombs. Since the drive charge amount of 255 coulombs is greater than the threshold for charge amount determination of 100 coulombs, the accumulated charge amount is determined, and the calculated accumulated charge amount is 10 coulombs. The drive charge amount at time T3 is 255 coulombs, the threshold for charge amount determination at time T3 is 100 coulombs, and the accumulated charge amount at time T3 is 10 coulombs. At time T3, since the drive charge amount of 255 coulombs is greater than the threshold for charge amount determination of 100 coulombs, the accumulated charge amount is determined. The current accumulated charge amount is 10+10=20 coulombs. The drive charge amount at time T4 is 30 coulombs, and the threshold for charge amount determination at time T4 is 50 coulombs. Therefore, at time T4, since the drive charge amount of 30 coulombs is less than the threshold for charge amount determination of 50 coulombs, there is no need to determine the accumulated charge amount, and the discharged charge amount is determined. If the discharged charge amount is 1, the charge amount after discharging is 20−1=19 coulombs. If the threshold for charge amount compensation is 5 coulombs, since the charge amount after discharging of 19 coulombs is greater than the threshold for charge amount compensation of 5 coulombs, it is necessary to compensate for the drive charge amount of 30 coulombs. The compensated charge amount is 30−(20−1)=11 coulombs. By using the compensated charge amount of 11 coulombs to drive the display of the current pixel, the display effect of the drive charge amount of 30 coulombs is realized. The drive charge amount at time T5 is 30 coulombs, and the threshold for charge amount determination at time T5 is 50 coulombs. At time T5, since the drive charge amount of 30 coulombs is less than the threshold for charge amount determination of 50 coulombs, there is no need to calculate the accumulated charge amount and the discharged charge amount is determined. If the discharged charge amount is 1, the charge amount after discharging is 20−1−1=18 coulombs. If the threshold for charge amount compensation at time T5 is 5 coulombs, since the discharged charge amount of 18 coulombs is greater than the threshold for charge amount compensation of 5 coulombs, it is necessary to compensate for the drive charge amount of 30 coulombs. The compensated charge amount is 30−(20−1−1)=12 coulombs. By using the compensated charge amount of 12 coulombs to display the current pixel at T5, the display effect of the drive charge amount of 30 coulombs is achieved.

The display control method according to the embodiments of the disclosure adjusts the charge amount required for driving the display based on the drive charge amount required for driving the current pixel and threshold for charge amount determination for the pixel circuit and for triggering the start of determining the accumulated charge amount in the pixel circuit. The adjusted charge amount drives the display of the current pixel to improve the visual impact of the temporary afterimages caused by the hysteresis effect on the user, thereby enhancing the user's visual experience.

Embodiments of the disclosure also provide a display control apparatus. Each unit in the display control apparatus may be implemented by hardware, or software, or a combination of hardware and software. Whether a unit is implemented by hardware, or software, or a combination of hardware and software may depend on the specific application and design constraints.

Figure 10:
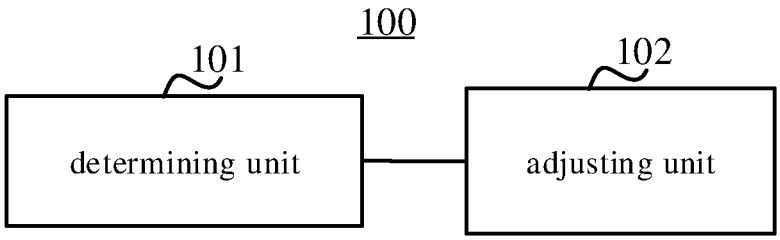
FIG. 10 is a block diagram of a display control apparatus according to exemplary embodiments.

FIG. 10 is a block diagram of a display control apparatus 100 according to exemplary embodiments. The display control apparatus is 100 applicable for an organic light-emitting diode (OLED) display screen, in which the OLED display screen includes a pixel circuit. As illustrated in FIG. 10, the display control apparatus 100 includes: a determining unit 101 and an adjusting unit 102.

The determining unit 101 is configured to determine a drive charge amount for driving display of a current pixel, and a threshold for charge amount determination for the pixel circuit, in which the threshold for charge amount determination is configured to trigger a start of determining an accumulated charge amount in the pixel circuit.

The adjusting unit 102 is configured to, in response to the drive charge amount being less than the threshold for charge amount determination, adjust the drive charge amount for driving the display of the current pixel.

In embodiments, the adjusting unit 102 is configured to, in response to the drive charge amount being greater than the threshold for charge amount determination, determine the accumulated charge amount in the pixel circuit, and drive the display of the current pixel based on the drive charge amount.

In embodiments, the adjusting unit 102 is configured to, in response to the drive charge amount being less than the threshold for charge amount determination, determine a currently discharged charge amount in the pixel circuit rather than the accumulated charge amount in the pixel circuit. The determining unit 101 is configured to determine a charge amount after discharging part of the charge amount in the pixel circuit based on the currently discharged charge amount in the pixel circuit. The adjusting unit 102 is configured to adjust the drive charge amount for driving the display of the current pixel by the following act: adjusting the drive charge amount for driving the display of the current pixel based on the charge amount after discharging part of the charge amount in the pixel circuit.

In embodiments, the adjusting unit 102 is configured to adjust the drive charge amount for driving the display of the current pixel based on the charge amount after discharging part of the charge amount in the pixel circuit by the following acts: in response to the charge amount after discharging part of the charge amount in the pixel circuit being greater than a threshold for charge amount compensation, compensating the drive charge amount; and driving the display of the current pixel based on the compensated drive charge amount. The charge amount compensation threshold is the corresponding accumulated charge amount when human eyes are triggered to perceive afterimages of the pixel circuit.

In embodiments, the adjusting unit 102 is configured to compensate the drive charge amount by the following act: determining a difference between the drive charge amount and the charge amount after discharging part of the charge amount in the pixel circuit as the compensated drive charge amount.

In embodiments, the adjusting unit 102 is configured to, in response to the charge amount after discharging part of the charge amount in the pixel circuit is less than the charge amount compensation threshold, drive the display of the current pixel based on the drive charge amount.

In embodiments, the determining unit 101 is configured to determine the charge amount after discharging part of the charge amount in the pixel circuit based on the currently discharged charge amount in the pixel circuit by the following acts: determining a currently accumulated charge amount corresponding to the drive charge amount based on a correspondence among drive charge amounts, accumulated light-emitting durations, and accumulated charge amounts; determining a currently discharged charge amount corresponding to the drive charge amount based on a correspondence among drive charge amounts, accumulated light-emitting durations, and discharged charge amounts; and determining a difference between the currently accumulated charge amount and the currently discharged charge amount as the charge amount after discharging part of the charge amount in the pixel circuit.

Regarding the apparatus in the foregoing embodiments, the specific manner in which each unit performs the operation has been described in detail in the method embodiments, and detailed description will not be repeated here.

Figure 11:
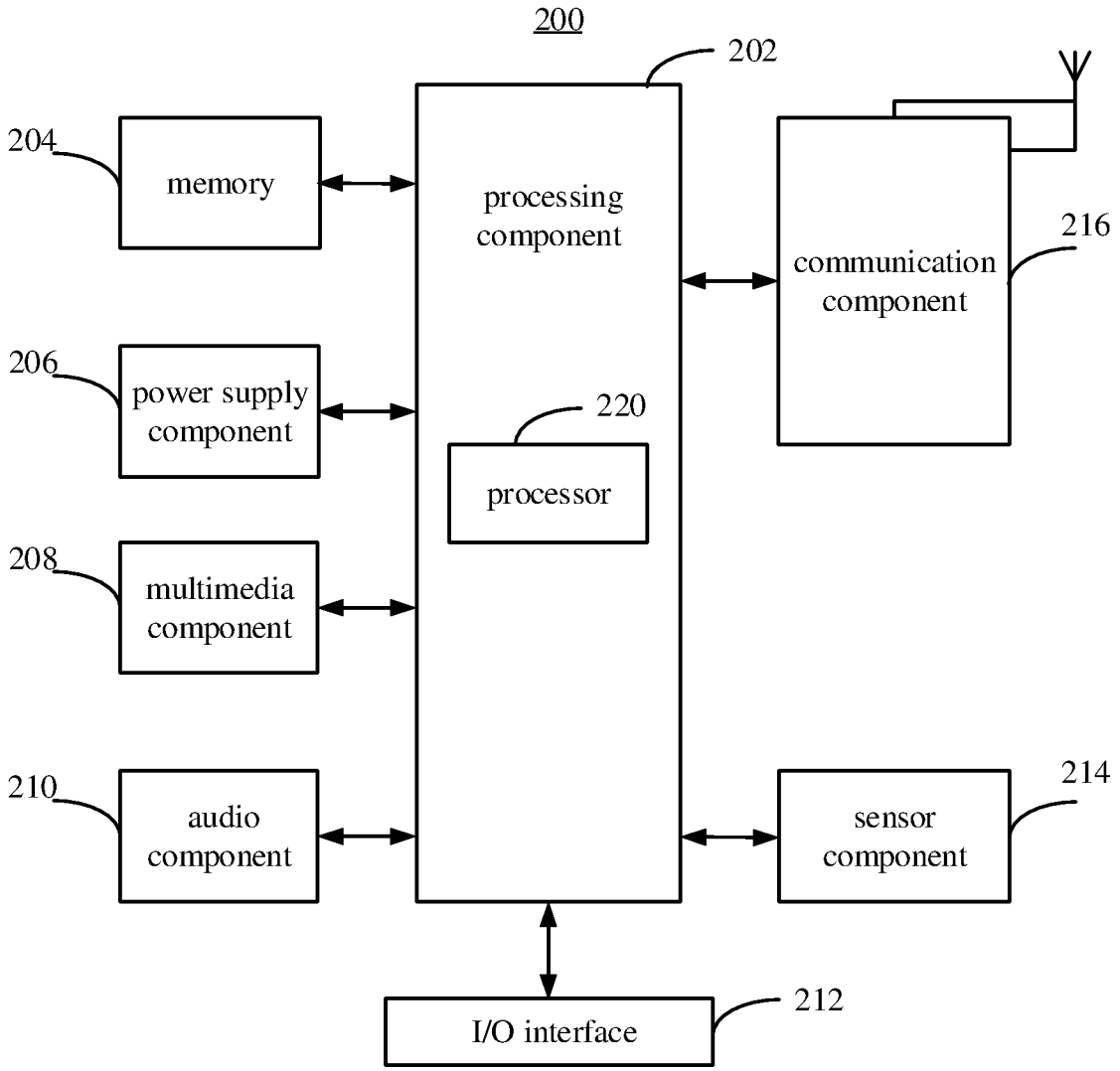
FIG. 11 is a block diagram of a display control apparatus device to exemplary embodiments.

FIG. 11 is a block diagram of a display control device 200 according to exemplary embodiments. For example, the device 200 may be a mobile phone, a computer, a digital broadcasting terminal, a message transceiver device, a game console, a tablet device, a medical device, a fitness device and a personal digital assistant.

Referring to FIG. 11, the device 200 may include one or more of the following components: a processing component 202, a memory 204, a power component 206, a multimedia component 208, an audio component 210, an input/output (I/O) interface 212, a sensor component 214, and a communication component 216.

The processing component 202 typically controls overall operations of the device 200, such as the operations associated with display, telephone calls, data communications, camera operations, and recording operations. The processing component 202 may include one or more processors 220 to execute instructions to perform all or part of the steps in the above described methods. Moreover, the processing component 202 may include one or more modules which facilitate the interaction between the processing component 202 and other components. For instance, the processing component 202 may include a multimedia module to facilitate the interaction between the multimedia component 208 and the processing component 202.

The memory 204 is configured to store various types of data to support the operation of the device 200. Examples of such data include instructions for any applications or methods operated on the device 200, contact data, phonebook data, messages, pictures, video, etc. The memory 204 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 206 provides power to various components of the apparatus device. The power component 206 may include a power management system, one or more power sources, and any other components associated with the generation, management, and distribution of power in the device 200.

The multimedia component 208 includes a screen providing an output interface between the apparatus device and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 208 includes a front-facing camera and/or a rear-facing camera. When the device 200 is in an operating mode, such as a shooting mode or a video mode, the front-facing camera and/or the rear-facing camera can receive external multimedia data. Each front-facing camera and rear-facing camera may be a fixed optical lens system or has focal length and optical zoom capability.

The audio component 210 is configured to output and/or input audio signals. For example, the audio component 210 includes a microphone ("MIC") configured to receive an external audio signal when the device 200 is in an operation mode, such as a call mode, a recording mode, and a voice recognition mode. The received audio signal may be further stored in the memory 204 or transmitted via the communication component 216. In some embodiments, the audio component 210 further includes a speaker to output audio signals.

The I/O interface 212 provides an interface between the device 200 and peripheral interface modules, such as a keyboard, a click wheel, buttons, and the like. The buttons may include, but are not limited to, a home button, a volume button, a starting button, and a locking button.

The sensor component 214 includes one or more sensors to provide status assessments of various aspects of the device 200. For instance, the sensor component 214 may detect an open/closed status of the device 200, relative positioning of components, e.g., the display and the keypad, of the device 200, a change in position of the device 200 or a component of the device 200, a presence or absence of user contact with the device 200, an orientation or an acceleration/deceleration of the device 200, and a change in temperature of the device 200. The sensor component 214 may include a proximity sensor configured to detect the presence of nearby objects without any physical contact. The sensor component 214 may also include a light sensor, such as a CMOS or CCD image sensor, for use in imaging applications. In some embodiments, the sensor component 214 may also include an accelerometer sensor, a gyroscope sensor, a magnetic sensor, a pressure sensor, or a temperature sensor.

The communication component 216 is configured to facilitate communication, wired or wirelessly, between the device 200 and other devices. The device 200 can access a wireless network based on a communication standard, such as WiFi, 4G, or 5G, or a combination thereof. In one exemplary embodiment, the communication component 216 receives a broadcast signal or broadcast associated information from an external broadcast management system via a broadcast channel. In one exemplary embodiment, the communication component 216 further includes a near field communication (NFC) module to facilitate short-range communications. In one exemplary embodiment, the communication component 216 may be implemented based on a radio frequency identity (RFID) technology, an infrared data association (IrDA) technology, an ultra-wideband (UWB) technology, a Bluetooth (BT) technology, and other technologies.

In exemplary embodiments, the device 200 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In exemplary embodiments, there is also provided a non-transitory computer readable storage medium including instructions, such as included in the memory 204, executable by the processor 220 in the device 200, for performing the above-described methods. For example, the non-transitory computer-readable storage medium may be a ROM, a RAM, a CD-ROM, a magnetic tape, a floppy disc, an optical data storage device, and the like.

In exemplary embodiments, there is also provided a non-transitory computer readable storage medium including instructions, when the instructions are executed by a processor of a mobile terminal, the mobile terminal can execute the display control method described above.

It is understood that although the operations are described in a specific order in the drawings in the embodiments of the disclosure, it should not be construed as requiring that the operations are performed in the specific order shown or in a serial order, or performed all to get the desired result. In certain environments, multitasking and parallel processing may be advantageous.

Other embodiments of the present disclosure will be apparent to those skilled in the art from consideration of the specification and practice of the described embodiments. This disclosure is intended to cover any variations, uses, or adaptive changes that follow the general principles of this disclosure and include common general knowledge or customary technical means in the technical field not disclosed in this disclosure. The description and examples are to be considered exemplary only, and the true scope and spirit of this disclosure are indicated by the claims.

It should be understood that the disclosure is not limited to the precise structure that has been described above and shown in the drawings, and various modifications and changes can be made without departing from the scope thereof. The scope of the disclosure is limited only by the appended claims.

What is claimed is:

1. A display control method for an organic light-emitting diode (OLED) display screen, the OLED display screen comprising a pixel circuit, the method comprising:

determining a drive charge amount for driving display of a current pixel, and a threshold for charge amount determination for the pixel circuit, wherein the threshold for charge amount determination is configured to trigger start of determining an accumulated charge amount in the pixel circuit; and in response to the drive charge amount being less than the threshold for charge amount determination, determining a currently discharged charge amount in the pixel circuit, determining a charge amount after discharging based on the currently discharged charge amount in the pixel circuit, and adjusting the drive charge amount for driving the display of the current pixel based on the charge amount after discharging.

2. The method of claim 1, further comprising:

in response to the drive charge amount being greater than the threshold for charge amount determination, determining the accumulated charge amount in the pixel circuit, and driving the display of the current pixel based on the drive charge amount.

3. The method of claim 1, wherein the adjusting the drive charge amount for driving the display of the current pixel based on the charge amount after discharging, comprises:

in response to the charge amount after discharging being greater than a threshold for charge amount compensation, compensating the drive charge amount; and driving the display of the current pixel based on the compensated drive charge amount.

4. The method of claim 3, wherein the compensating the drive charge amount comprises:

determining a difference between the drive charge amount and the charge amount after discharging as the compensated drive charge amount.

5. The method of claim 3, further comprising:

in response to the charge amount after discharging being less than the charge amount compensation threshold, driving the display of the current pixel based on the drive charge amount.

6. The method of claim 1, wherein the determining the charge amount after discharging based on the currently discharged charge amount in the pixel circuit comprises:

determining a currently accumulated charge amount corresponding to the drive charge amount based on a correspondence among drive charge amounts, accumulated light-emitting durations, and accumulated charge amounts;

determining a currently discharged charge amount corresponding to the drive charge amount based on a correspondence among drive charge amounts, accumulated light-emitting durations, and discharged charge amounts; and determining a difference between the currently accumulated charge amount and the currently discharged charge amount as the charge amount after discharging.

7. A display control device for an organic light-emitting diode (OLED) display screen, the OLED display screen comprising a pixel circuit, the device comprising:

a processor; and a memory for storing instructions executable by the processor; wherein the processor is configured to perform:

determining a drive charge amount for driving display of a current pixel, and a threshold for charge amount determination for the pixel circuit, wherein the threshold for charge amount determination is configured to trigger start of determining an accumulated charge amount in the pixel circuit; and in response to the drive charge amount being less than the threshold for charge amount determination, determining a currently discharged charge amount in the pixel circuit, determining a charge amount after discharging based on the currently discharged charge amount in the pixel circuit, and adjusting the drive charge amount for driving the display of the current pixel based on the charge amount after discharging.

8. The device of claim 7, wherein the processor is further configured to perform:

in response to the drive charge amount being greater than the threshold for charge amount determination, determining the accumulated charge amount in the pixel circuit, and driving the display of the current pixel based on the drive charge amount.

9. The device of claim 7, wherein the processor is further configured to perform:

in response to the charge amount after discharging being greater than a threshold for charge amount compensation, compensating the drive charge amount; and driving the display of the current pixel based on the compensated drive charge amount.

10. The device of claim 9, wherein the processor is further configured to perform:

determining a difference between the drive charge amount and the charge amount after discharging as the compensated drive charge amount.

11. The device of claim 9, wherein the processor is further configured to perform:

in response to the charge amount after discharging being less than the charge amount compensation threshold, driving the display of the current pixel based on the drive charge amount.

12. The device of claim 7, wherein the processor is further configured to perform:

determining a currently accumulated charge amount corresponding to the drive charge amount based on a correspondence among drive charge amounts, accumulated light-emitting durations, and accumulated charge amounts;

determining a currently discharged charge amount corresponding to the drive charge amount based on a correspondence among drive charge amounts, accumulated light-emitting durations, and discharged charge amounts; and determining a difference between the currently accumulated charge amount and the currently discharged charge amount as the charge amount after discharging.

13. A non-transitory computer-readable storage medium having stored therein instructions that, when executed by a processor of a device, causes the device to perform a display control method for an organic light-emitting diode (OLED) display screen, the OLED display screen comprising a pixel circuit, and the method comprising:

determining a drive charge amount for driving a display of a current pixel, and a threshold for charge amount determination for the pixel circuit, wherein the threshold for charge amount determination is configured to trigger start of determining an accumulated charge amount in the pixel circuit; and in response to the drive charge amount being less than the threshold for charge amount determination, determining a currently discharged charge amount in the pixel circuit, determining a charge amount after discharging based on the currently discharged charge amount in the pixel circuit, and adjusting the drive charge amount for driving the display of the current pixel based on the charge amount after discharging.

14. The non-transitory computer-readable storage medium of claim 13, wherein the method further comprises:

in response to the drive charge amount being greater than the threshold for charge amount determination, determining the accumulated charge amount in the pixel circuit, and driving the display of the current pixel based on the drive charge amount.

15. The non-transitory computer-readable storage medium of claim 13, wherein the adjusting the drive charge amount for driving the display of the current pixel based on the charge amount after discharging comprises:

in response to the charge amount after discharging being greater than a threshold for charge amount compensation, compensating the drive charge amount; and driving the display of the current pixel based on the compensated drive charge amount.

16. The non-transitory computer-readable storage medium of claim 15, wherein the compensating the drive charge amount comprises:

determining a difference between the drive charge amount and the charge amount after discharging as the compensated drive charge amount.

17. The non-transitory computer-readable storage medium of claim 15, wherein the method further comprises:

in response to the charge amount after discharging being less than the charge amount compensation threshold, driving the display of the current pixel based on the drive charge amount.

18. The non-transitory computer-readable storage medium of claim 13, wherein the determining the charge amount after discharging based on the currently discharged charge amount in the pixel circuit comprises:

determining a currently accumulated charge amount corresponding to the drive charge amount based on a correspondence among drive charge amounts, accumulated light-emitting durations, and accumulated charge amounts;

determining a currently discharged charge amount corresponding to the drive charge amount based on a correspondence among drive charge amounts, accumulated light-emitting durations, and discharged charge amounts; and determining a difference between the currently accumulated charge amount and the currently discharged charge amount as the charge amount after discharging.

* * * * *